US006870116B2

(12) United States Patent
Kiyosawa et al.

(10) Patent No.: US 6,870,116 B2
(45) Date of Patent: Mar. 22, 2005

(54) PUSH-BUTTON SWITCH-USE MEMBER AND PRODUCTION METHOD THEREFOR

(75) Inventors: Mikio Kiyosawa, Shiojiri (JP); Takashi Kawamura, Kodama-gun (JP)

(73) Assignee: Shin-Etsu Polymer Co., Ltd., Tokyo (JP)

( * ) Notice: Subject to any disclaimer, the term of this patent is extended or adjusted under 35 U.S.C. 154(b) by 0 days.

(21) Appl. No.: 10/484,448

(22) PCT Filed: Sep. 4, 2002

(86) PCT No.: PCT/JP02/08980

§ 371 (c)(1),
(2), (4) Date: Jan. 21, 2004

(87) PCT Pub. No.: WO03/028054

PCT Pub. Date: Apr. 3, 2003

(65) Prior Publication Data

US 2004/0168898 A1 Sep. 2, 2004

(30) Foreign Application Priority Data

Sep. 21, 2001 (JP) ..... 2001-289892

(51) Int. Cl.[7] ..... H01H 13/14
(52) U.S. Cl. ..... 200/520; 200/512; 200/341

(58) Field of Search ..... 200/520, 512, 200/510, 341, 5 A

(56) References Cited

U.S. PATENT DOCUMENTS

| | | | | |
|---|---|---|---|---|
| 3,562,466 A | * | 2/1971 | McElligott | 200/511 |
| 3,654,407 A | * | 4/1972 | Kepner et al. | 200/86 R |
| 6,326,571 B1 | * | 12/2001 | Kitamura et al. | 200/520 |
| 6,429,668 B1 | * | 8/2002 | Billen et al. | 324/699 |

FOREIGN PATENT DOCUMENTS

| | | |
|---|---|---|
| JP | 57-95020 | 6/1982 |
| JP | 04-012417 | 1/1992 |
| JP | 10-144168 | 5/1998 |
| JP | 2000-173375 | 6/2000 |
| JP | 2000-222977 | 8/2000 |

* cited by examiner

*Primary Examiner*—K. Lee
(74) *Attorney, Agent, or Firm*—Wenderoth, Lind & Ponack, L.L.P.

(57) ABSTRACT

In a push-button switch member provided with a movable contact composed of a metal member constituting a contact surface to contact an opposing electrode, a number of holes are formed in the contact surface in a height direction of the metal member, and the holes are filled with a filler formed of a flexible resin.

21 Claims, 5 Drawing Sheets

PUSH-BUTTON SWITCH-USE MEMBER AND PRODUCTION METHOD THEREFOR

This application is a National Stage of PCT/JP02/08980 filed Sep. 4, 2002.

TECHNICAL FIELD

The present invention relates to a member for a push-button switch provided with a metal member for contacting an opposing electrode, and more specifically, to a member for a push-button switch, and a manufacturing method of the same, that hardly causes a conductive fault even in presence of a fine insulating foreign material between the push-button switch member and the opposing electrode.

BACKGROUND ART

In a push-button switch utilized for a power window, door mirror or the like, high current of 100 to 500 mA is conducted, so that a plate-shaped metal member is used as a member for the push-button switch (which may be merely called hereinafter a push-button switch member). Further, during a normally-closed type contact, in order to prevent a so-called sticking phenomenon in which a push-button switch member is closely contacted by an opposing electrode and is never separated therefrom, a plate-shaped metal member is used as the push-button switch member.

FIG. 7 is a schematic partial sectional view showing a push-button switch capable of withstanding such a high current.

In this figure, reference numeral 1 denotes a contact structure composed of a plate-shaped metal, a keypad 2 is formed of a resin such as silicone rubber which is operatively pushed from an external side, and the contact structure 1 is integrally formed on the keypad 2 in a manner opposing an opposing electrode 4 of a stationary substrate 3 so as to be capable of being contacted by the contact structure 1, thus constituting a movable contact.

In a conventional technology, there has been widely used a metal plate, which is formed by gold-plating a German silver metal sheet, and then punching out therefrom a predetermined shape. At a time when such contact structure 1 is contacted with the opposing electrode 4, since a current passes through such contacting of the metal plate having good conductive performance with the opposing electrode 4, high current can be conducted, and moreover, since the metal plate has a strength strong enough to substantially prevent the contact structure 1 from being damaged or broken through a repeated pushing or pressing operation 5 applied to a push-button B, and hence, strong enough to provide desired durability.

However, in the contact structure 1 composed of such plate-shaped metal, the metal plate is too strong to be deformed. Accordingly, as shown in FIG. 8, if fine foreign material 5 such as dirt or dust having an insulating property intrudes into the switch and adheres to a portion between the contact structure 1 and the opposing electrode 4, it is difficult for the metal plate to be deformed in accordance with a shape of the fine foreign material 5 at a time when the contact structure 1 contacts the opposing electrode 4, which will adversely result in formation of a wide gap 5*a* therebetween, largely reducing a contacting area and, hence, causing defective conduction of the push-button switch, thus providing problems.

SUMMARY OF THE INVENTION

The present invention therefore provides a member for a push-button switch positively preventing reduction of contacting area of a contact structure and an opposing electrode, both constituting a movable contact, even if insulating foreign material exists between the contact structure and the opposing electrode, and providing an improved durability. The present invention also provides a manufacturing method capable of easily manufacturing such a push-button switch member.

In order to achieve such object, the first invention provides a member for a push-button switch having a movable contact made of a metal member consisting of a contact surface to be contacted to an opposing electrode, in which a number of holes are formed to the contact surface so as to extending in a height direction thereof, a metal wall constituting a portion of a metal member, to which the holes are formed, has a flat surfaced end portion on the side of the opposing electrode, and the holes are filled up with a filler formed of flexible resin so that the metal wall is reinforced.

According to this invention, at a time of contacting the member for the push-button switch with the opposing electrode, even in presence of insulating foreign material in the holes formed in the contact surface between the opposing electrode and the contact structure, it is possible for insulating foreign material having a size smaller than a sectional area of the hole to intrude into the holes, so that a contacting area between the opposing electrode and an end portion of the metal wall of the metal member surrounding the holes constituting the contact surface is not reduced. Furthermore, even in presence of the insulating foreign material at an end portion of a metal wall sectioning adjacent holes, the metal member can be easily deformed because of formation of the holes, so that the metal member can be locally deformed in accordance with the insulating foreign material, and the contacting area is thus not largely reduced. Therefore, even in the presence of the insulating foreign material, having a size smaller than a sectional area of the hole, between the push-button switch member and the opposing electrode, sufficient contacting area can be ensured, thus hardly causing conductive fault or conduction trouble. Moreover, even if the end portion of the metal wall of the metal member is easily deformed, the metal wall surrounding each of the holes oriented in a height (depth) direction thereof has a solid structure, so that the metal member can provide a desired strength as a whole, thus ensuring durability.

Furthermore, since the holes are filled with the filler formed of flexible resin, wall sections between adjacent holes can be reinforced by the filler, and in addition, since the filler is formed of flexible resin, local deformation of the metal member cannot be adversely obstructed. Therefore, the metal member, even having a thin wall, can be hardly broken by a repeated local deforming force, thus improving durability.

According to a second aspect of the invention, in addition to the first aspect, the filler is filled to a full height direction of the metal member.

Accordingly, an end portion of the filler provides a same flat surface as that of an end portion of the metal walls, and the metal walls can be entirely reinforced by the filler, so that excellent durability can be provided. Moreover, even if insulating foreign material intrudes into the holes, the insulating foreign material can be easily separated from the holes at a time when the push-button switch member is separated from the opposing electrode, by an elastic recovering force of the end portion of the filler, so that repeated use during normal conditions can always be ensured.

According to a third aspect of the invention, in addition to the first and second aspects, the metal member has a honeycomb shape dense structure formed with a number of through holes having the same sectional shape.

Accordingly, in addition to the first and second aspects, strength in the full height direction of the metal member can be increased, and the metal walls between adjacent through holes can be made thinner, so that flexibility of the end portion of the metal walls can be further improved while maintaining improved durability.

The invention also includes a method of manufacturing a member for push-button switch provided with a movable contact composed of a metal member constituting a contact surface to oppose an opposing electrode, which is characterized by comprising the steps of: forming a number of through holes in a metal member so as to penetrate in a height direction thereof; arranging a filler formed of a flexible resin sheet on one end surface side of the metal member; forming a metal member base material in which the through holes are filled with the filler to their full height amount by pressurizing the metal member in a height direction thereof; punching out the metal member base material so as to provide a contact structure having a predetermined shape; and joining the contact structure to a keypad.

The metal member which is made deformable by formation of the through holes is reinforced by the filler, so that deformation of the metal member during the punching-out operation can be prevented and a degree of flatness of a contact surface during the manufacturing process cannot be damaged. Accordingly, the member for the push-button switch can be easily manufactured.

BRIEF DESCRIPTION OF THE DRAWINGS

FIGS. 6A–6C are sectional views for explaining a manufacturing process of the contact structure, wherein FIG. 6A shows a state in which through holes are formed in a metal sheet, FIG. 6B shows a filler sheet laminated onto one side surface of the metal sheet, and FIG. 6C shows a product formed by filling the filler into the through holes.

DETAILED DESCRIPTION OF THE PREFERRED EMBODIMENTS

A mode for embodying the present invention will be described hereunder with reference to the accompanying drawings.

Figure 1:
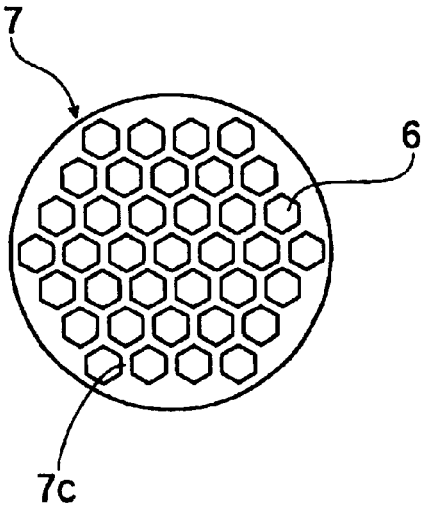
FIG. 1 is a plan view of a metal member of a contact structure of a push-button switch member according to an embodiment of the present invention.
Figure 2:
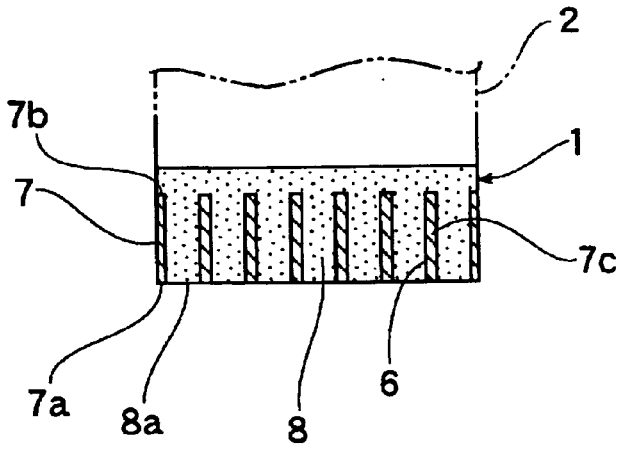
FIG. 2 shows a vertical sectional view of an essential portion of the contact structure of FIG. 1.
Figure 3:
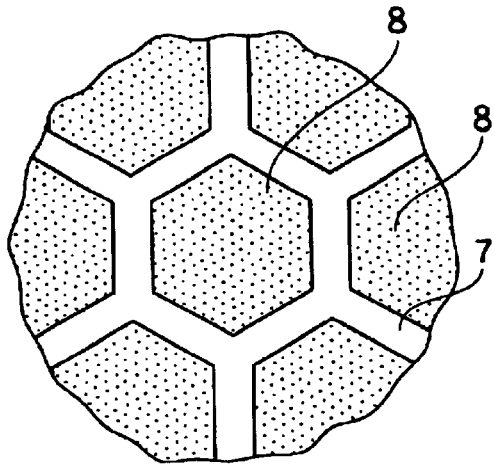
FIG. 3 is an enlarged view of one end of the contact structure of FIG. 1.
Figure 8:
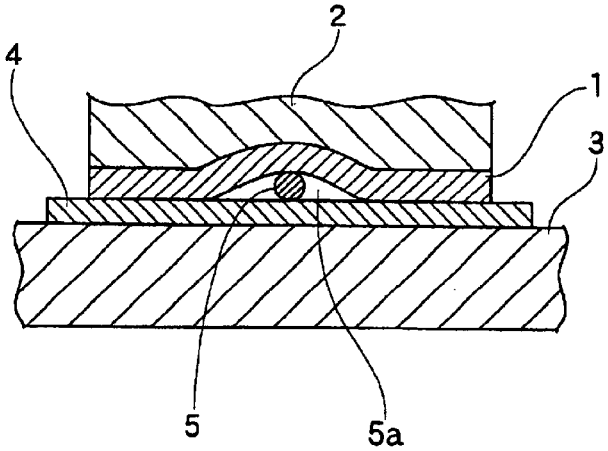
FIG.8 PRIOR ART
FIG. 8 is a sectional view of an essential portion showing a contacting state between a conventional contact structure composed of a plate-shaped metal and an opposing electrode.

A contact structure of a push-button switch member according to an embodiment of the present invention is shown in FIGS. 1 and 2. Further, it is to be noted that a state in which this contact structure is applied to a keypad is identical to that shown in FIG. 8.

FIG. 1 is a plan view of a metal member of the contact structure. FIG. 2 is a vertical view of an essential portion of the contact structure of the push-button switch member.

This contact structure 1 is provided with a metal member 7 having a dense structure of a substantially honeycomb shape formed with a plurality of through holes 6, which have the same sectional shape, penetrating in a height (depth) direction of the metal member. The contact structure 1 is also provided with a filler 8 formed of flexible resin, such as silicone rubber, filling the through holes 6 of the metal member 7 from a side of a keypad 2. In the illustrated example, the filler 8 is arranged so that one end portion 8*a* of the filler 8 is substantially co-planar with one end portion 7*a*, in the height direction, of the metal member 7, and there exists no filler 8 on an outer surface of the end portion 7*a*, thus constituting a contact surface for an opposing electrode 4. On the other hand, there may exist filler 8 on another end portion 7*b* of the metal member 7, and the metal member 7 is joined to the keypad 2 through the filler 8 existing on a side of the other end portion 7*b*.

Further, herein, the honeycomb shape dense structure of the metal member 7 indicates a structure, as shown in FIG. 2, in which a plurality of mutually adjacent through holes 6 are formed close to each other through metal walls 7*c* having equal height. That is, it is not always necessary for through hole 6 to have the same sectional shape as that of a hexagon of the honeycomb structure, and it may be possible for the through hole to have another polygonal shape such as a triangular, pentagonal or octagonal shape, or even to have a circular shape. The metal walls 7*c*, each constituting a boundary between two adjacent through holes 6, are all continuous, and in order to provide the metal walls 7*c* having an equal thickness, the sectional shape of each through hole 6 may be selected from a triangular, quadrangular or hexagonal shape.

According to the contact structure 1 of the structure mentioned above, by pushing the keypad 2 so as to abut the opposing electrode 4, one end 7*a* of the metal member 7 contacts the opposing electrode 4, thus being conductive.

Figure 4:
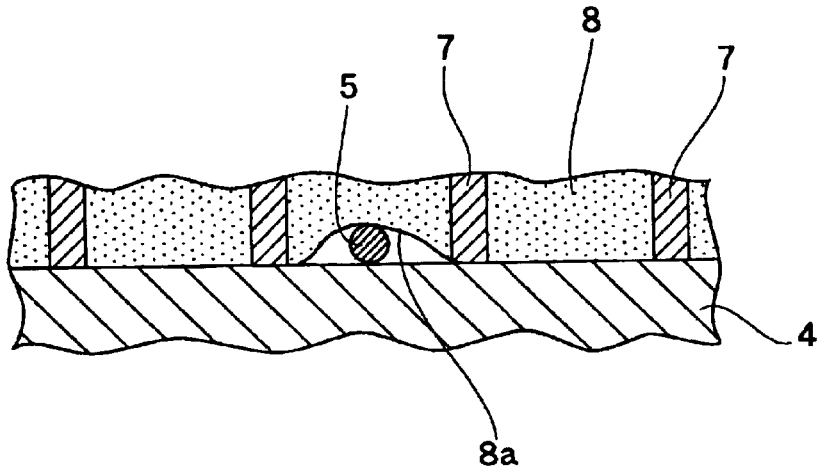
FIG. 4 is a view explaining a state in which an insulating foreign material exists between a filler of the contact structure and an opposing electrode.

In this situation, at a time when a fine insulating foreign material 5 having a size smaller than a sectional area of the through hole 6 adheres to the contact structure 1 and/or opposing electrode 4, the insulating foreign material 5 is clamped between the contact structure 1 and the opposing electrode 4 at a time of contacting. In the state of FIG. 4, the insulating foreign material 5 is clamped between the end portion 8*a* of the filler 8 and the opposing electrode 4, and in a state of FIG. 5, the insulating foreign material 5 is clamped between the end portion 7*a* of the metal member 7 and the opposing electrode 4.

As shown in FIG. 4, showing the contact structure 1, in which the insulating foreign material 5 is clamped between the end portion 8*a* of the filler 8 and the opposing electrode 4, the filler 8 is deformed by the insulating foreign material 5 and the foreign material 5 intrudes into the through hole 6, so that a contacting area between the end portion 7*a* of the metal member 7 and the opposing electrode 4 is never reduced.

Figure 5:
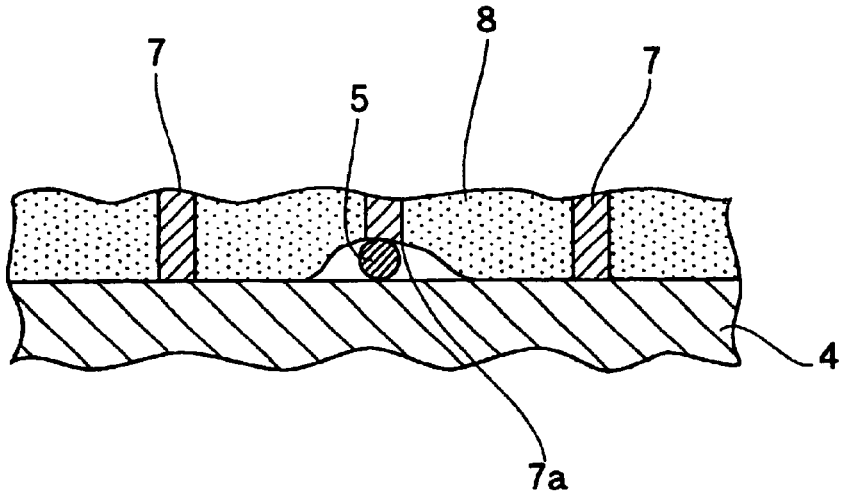
FIG. 5 is a view explaining a state in which an insulating foreign material exists between a metal member of the contact structure and the opposing electrode.

On the other hand, as shown in FIG. 5, showing the contact structure 1, in which the insulating foreign material 5 is clamped between the end portion 7*a* of the metal member 7 and the opposing electrode 4, since the metal walls 7*c* of the metal member 7 have a small thickness and are arranged in a separated fashion via the through holes 6, it is easy to locally deform the metal walls 7*c*, and accordingly, the metal member 7 can be locally deformed in accordance with a shape of the insulating foreign material 5. Because of this reason, even in presence of the insulating foreign material 5, a contacting area between the end portion 7*a* of the metal member 7 and the opposing electrode 4 is not largely reduced. This tendency will likely be observed in a case of an insulating foreign material 5 having a size slightly larger than the sectional area of the through hole 6.

That is, according to the contact structure mentioned above, even in the case where the insulating foreign material 5, such as dust or dirt, intruding into the switch member exists between the opposing electrode 4 and the push-button switch member 1, since a plurality of through holes 6 are formed at the end portion 7*a* of the metal member 7, when the insulating foreign material 5 intrudes into the through holes 6 or the metal member 7 a wall 7*c* defining a corresponding through hole is locally deformed in accordance with the insulating foreign material 5 to thereby suppress reduction of a contacting area, thus making it difficult to cause a defective conduction.

Moreover, different from a structure in which the metal member 7 is merely formed to be thin, the metal walls 7*c* provide a solid structure by a plurality of through holes 6 oriented in the height direction, so that it is possible to sufficiently ensure strength of the metal member 7 in its entirety, thus preventing degradation of durability of the contact structure.

Furthermore, since the through holes 6 are filled with the filler 8, the structure can be reinforced by the filler 8 even if metal walls 7*c* are formed to be thin, and moreover, since this filler 8 is formed of a flexible resin material the metal member is allowed to be locally deformed. Thus, the thin metal walls 7*c* can be subjected to repeated local deformation and durability of the structure can thus be ensured.

In order to obtain a desired reinforcing effect, it is preferred to use the filler 8 of a filling amount satisfying at least more than ½ a height of the metal member 7, and specifically, by filling up to a full height of the through holes 6 so that the end portion 8*a* of the filler 8 is co-planar with the end portion 7*a* of the metal walls 7*c*, and all the metal walls 7*c* are reinforced by the filler 8, so that further improved durability is obtainable. Moreover, even if the insulating foreign material 5 intrudes into a through hole 6, the insulating foreign material 5 can be easily removed from the through hole 6 at a time of separation of the contact structure 1 from the opposing electrode 4, due to an elastic restoring force of the end portion 8*a* of the filler 8, so that the contact structure can be repeatedly always used in a stable condition.

Furthermore, since the metal member 7 has approximately a honeycomb shape dense structure, the metal member 7 can provide high mechanical strength in its height direction, and at any portion of the end portion 7*a* of the metal member 7 it is possible to make the metal walls 7*c* thinner, thus making a contact surface more flexible while suitably maintaining durability.

Still furthermore, since the metal member 7 is formed from a sheet member formed with a number of through holes 6, and accordingly, the end portion 7*a*, constituting a contacting surface, of the metal walls 7*c* of the metal member 7 is formed to provide a planar shape, it is possible to make larger a contacting area in comparison with a structure in which a member such as a metal mesh, which is formed by knitting warp and weft wires or the like each having a diameter substantially identical to a thickness of metal wall 7*c*, contacts at points separated from each other. Also, pressure on the contacting surface and stress applied to the metal walls 7*c* are made uniform, so that the structure provides less fatigue even during repeated use and suitable durability can be maintained.

In the illustrated embodiment, although the metal member 7 is formed with the through holes 6 penetrating in the height direction thereof, it is not always necessary for the through holes 6 to penetrate to the same extent in the height direction of the metal member 7. In other words, with such a structure, even if the insulating foreign material 5 having a size smaller than the holes adheres to the contact surface, the material 5 invades into the hole formed in the contact surface of the metal member 7, so that the contacting area between the end portion 7*a* of the metal member 7 and the opposing electrode 4 is never reduced, and hence, conductive performance is never deteriorated.

Hereunder, a manufacturing method of the push-button switch member adopting such contact structure 1 as that mentioned above will be described.

Figure 6A:
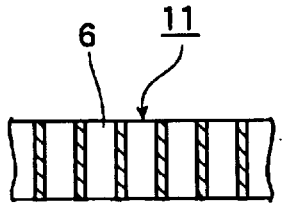
Figure 6B:
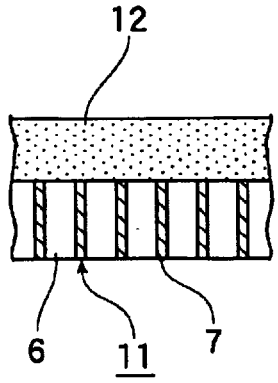
Figure 6C:
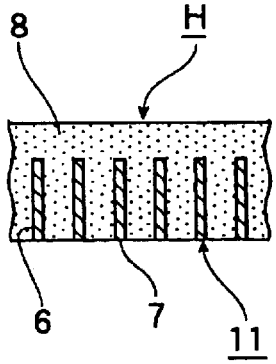
Figure 7:
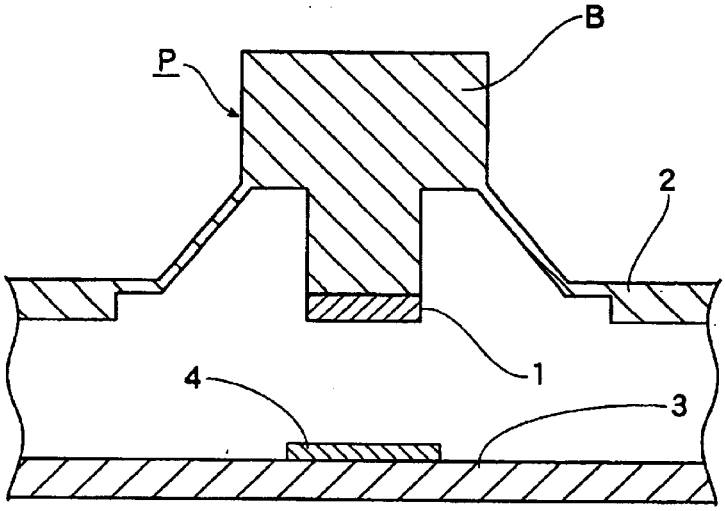
FIG.7 PRIOR ART
FIG. 7 is a schematic sectional view showing a conventional push-button switch.

In order to manufacture the contact structure 1 shown in FIG. 1, a number of through holes 6, which penetrate a metal sheet in its height direction, are formed in the metal sheet, for example, by performing an etching treatment to thereby obtain a metal sheet 11 having a dense structure in a form of honeycomb structure. The metal sheet 11 is then subjected to a primer treatment, and as shown in FIG. 6*b*, a filler sheet 12 made of silicone rubber is laminated onto one side surface of the metal sheet 11. Thereafter, such filler sheet 12 is pressurized in a height direction by use of a predetermined mold and then heated so as to provide an integrated structure. According to such a process, as shown in FIG. 6*c*, a base material H of a metal body is produced in which a number of through holes 6 are filled with material of the filler sheet 12 (i.e. filler 8) in their full height direction. During this process, attention is paid so that the filler 8 remains on one side surface of metal body base material H, but the filler does not exist on another side surface thereof. This thus formed metal sheet is punched out in a predetermined shape to thereby obtain the contact structure 1 such as shown in FIG. 1.

Further, by joining keypad 2, formed of silicone rubber, to a surface on which the filler 8 exists, because the filler 8 and the keypad 2 provide the same material, a member P for the push-button switch in which these materials are integrated can be easily completed.

In such a manufacturing method of the contact structure 1, since the filler sheet 12 is arranged on the metal sheet 11 having a number of through holes 6 formed so as to penetrate in the height direction, which is then pressurized in the height direction, it is easy to fill the through holes 6 with the filler 8. Moreover, the metal sheet 11 is punched out so as to provide a predetermined shape with the through holes 6 being filled with the filler 8, so that the metal member 7, which is easily deformable because of formation of a number of through holes 6, can be reinforced by the filler 8, and the metal member 7 can be prevented from being deformed during a punch-out process of the metal sheet or a process of being joined to the keypad 2. Accordingly, a degree of flatness of the end portion 7*a* constituting the contact surface will be easily maintained, thereby enabling the member P for the push-button switch to by easily manufactured.

Examples of the present invention will be next described hereunder.

EXAMPLE 1

A metal sheet 11 having a dense structure, in which a number of through holes 6, each having a hexagonal shape, are arranged so as to provide a honeycomb structure was manufactured by performing an etching treatment on a metal sheet formed of SUS304 and having a thickness of 50 $\mu$m. In this thus manufactured metal sheet 11, end portions 7*a*, 7*b* of metal wall 7*c* had a thickness (line width, hereinafter) of 20 $\mu$m, a width between parallel metal walls 7*c*, 7*c* (space width, hereinafter) was 185 $\mu$m, a sectional area of the through holes 6 (hole area, hereinafter) was 29640 $\mu m^2$, a hole area/metallic portion area of this manufactured metal sheet (opening, hereinafter) was 81.4%, and a filling rate (100 minus opening) was 18.6%.

A primer treatment was then effected in a manner such that primer No. 18 (manufactured by Shin-Etsu Chemical Co., Ltd.) was coated onto one side of the metal sheet by using a brush, which was then dried for one hour in an environment at a temperature of 200° C.

A laminated body was obtained by bonding, to this primer treatment surface, a filler sheet 12, which was a silicone rubber (which was prepared by mixing silicone compound KE-951U of 100 parts by weight, manufactured by Shin-Etsu Chemical Co., Ltd. and a cross-linking agent C-8 of 2 parts by weight, manufactured by Shin-Etsu Chemical Co., Ltd.) and having a height of 1.0 mm.

In a subsequent process, this laminated body was placed in a predetermined mold and then formed under compression at a temperature of 160° C. and a pressure of 180 kg/cm$^2$ for 5 minutes, thus obtaining a product in a shape of a sheet in which a number of through holes 6 were filled with silicone rubber in their full height direction.

This thus obtained product was then punched out so as to provide a predetermined shape to thereby obtain contact structure 1.

Furthermore, this thus obtained contact structure 1 was placed in a mold for formation of a predetermined keypad with a surface covered by silicone rubber being directed upwardly, and a silicone rubber sheet, which was formed of a silicone rubber (which was prepared by mixing silicone compound KE-941U of 100 parts by weight, manufactured by Shin-Etsu Chemical Co., Ltd. a cross-linking agent C-8 of 2 parts by weight, manufactured by Shin-Etsu Chemical Co., Ltd.) and having a height of 2.0 mm was placed on the silicone rubber covering the surface. This structure was then formed under compression at a temperature of 175° C. and a pressure of 200 kg/cm$^2$ for 5 minutes, thus obtaining a member P for a push-button switch composed of an integrated body of the contact structure 1 and the keypad 2.

This thus manufactured member P for the push-button switch was applied to the push-button switch such as shown in FIG. 1, and a predetermined number of insulating foreign materials 5, each being substantially spherical and having a particle diameter of 50 $\mu$m, was distributed almost evenly on an opposing electrode 4. In this state, electrical characteristics were measured for performing a conduction test.

During such conduction test, an amount of arranged insulating foreign materials 5 was changed and an amount of times the switch was pressed was also changed to thereby measure a voltage drop value under a voltage of DC12V and load of 500 mA. This switch pressing was performed 3.3 times/sec with a load of 200 g. Test results are shown in Table 1.

COMPARATIVE EXAMPLE 1

A member for a push-button switch was manufactured by substantially the same conditions as those in Example 1, except that the through holes 6 were not formed in the metal sheet 11, and the same conduction test as that of Example 1 was performed. Test results are shown in Table 1.

TABLE 1

(Unit: V)

| Classification | The Number of Times The Switch Was pressed | The Number of Arranged Insulating Foreign Materials 1 | 5 | 10 | 15 | 20 | 40 | 60 |
|---|---|---|---|---|---|---|---|---|
| Example 1 | 0 | 0.27 | 0.26 | 0.28 | 0.26 | 0.27 | 0.27 | 0.27 |
| | 1 | 0.28 | 0.28 | 0.29 | 0.28 | 0.27 | 0.28 | 0.28 |
| | 100 | 0.28 | 0.28 | 0.28 | 0.26 | 0.27 | 0.27 | 0.27 |
| | 300 | 0.29 | 0.29 | 0.28 | 0.28 | 0.29 | 0.28 | 0.28 |
| | 500 | 0.28 | 0.28 | 0.29 | 0.30 | 0.30 | 0.29 | 0.29 |
| Comparative Example 1 | 0 | 0.27 | 0.28 | 0.27 | 0.27 | 0.28 | 0.27 | 0.26 |
| | 1 | 0.26 | 0.27 | 0.27 | 0.28 | 0.27 | 0.26 | 0.26 |
| | 100 | 0.28 | 0.27 | 0.26 | 0.27 | 0.27 | 0.37 | 0.28 |
| | 300 | 0.28 | 0.37 | 0.26 | 0.26 | 0.43 | 0.37 | 0.37 |
| | 500 | 0.27 | 0.28 | 0.29 | 0.39 | 0.29 | 0.50 | 0.71 |

EXAMPLE 2 AND COMPARATIVE EXAMPLE 2

The same conduction tests were performed, by using the same contact structures as those of Example 1 and Comparative Example 1, except that insulating foreign materials 5, each being substantially spherical and having an average particle diameter of 100 $\mu$m, were utilized. Test results are shown in Table 2.

TABLE 2

(Unit: V)

| Classification | The Number of Times The Switch was pressed | The Number of Arranged Insulating Foreign Materials 1 | 5 | 10 | 15 | 20 | 40 | 60 |
|---|---|---|---|---|---|---|---|---|
| Example 2 | 0 | 0.26 | 0.28 | 0.28 | 0.25 | 0.27 | 0.28 | 0.27 |
| | 1 | 0.27 | 0.29 | 0.28 | 0.27 | 0.27 | 0.27 | 0.27 |
| | 100 | 0.28 | 0.27 | 0.29 | 0.28 | 0.27 | 0.28 | 0.28 |
| | 300 | 0.29 | 0.29 | 0.28 | 0.28 | 0.29 | 0.28 | 0.28 |
| | 500 | 0.28 | 0.28 | 0.29 | 0.29 | 0.29 | 0.28 | 0.29 |
| Comparative Example 2 | 0 | 0.26 | 0.27 | 0.26 | 0.27 | 0.29 | 0.27 | 0.26 |
| | 1 | 0.25 | 0.28 | 0.48 | 0.27 | NG | NG | NG |
| | 100 | 0.28 | 0.28 | 0.26 | 0.38 | 1.01 | NG | NG |
| | 300 | 0.28 | 0.57 | 0.26 | NG | NG | NG | NG |
| | 500 | 0.27 | 0.28 | 0.29 | NG | NG | NG | NG |

Note 1) NG shows an incapable measurement due to over limiting value

EXAMPLE 3

The same conduction test was performed by using the same contact structure as that in Example 1, except that there was used a metal sheet 11 composed of SUS304 having a height of 50 $\mu$m and having a dense structure in a form of a substantially honeycomb shape having a line width of 45 $\mu$m, a space width of 380 $\mu$m, a hole area of 125054 $\mu$m$^2$ and an opening of 79.9%, and silicone rubber having a filling rate of 20.1%, and except that insulating foreign materials 5, each being substantially spherical and having a particle diameter of 200 $\mu$m, were used. Test results are shown in Table 3.

COMPARATIVE EXAMPLE 3

The conduction test was performed by using the same contact structure 1 as that of Comparative Example 1, which was manufactured with no formation of through holes 6 in metal sheet 11, with the same condition as that of the Example 3. Test results are shown in Table 3.

TABLE 3

(Unit: V)

| Classification | The Number of Times The Switch was pressed | The Number of Arranged Insulating Foreign Materials 1 | 5 | 10 | 15 | 20 | 40 | 60 |
|---|---|---|---|---|---|---|---|---|
| Example 3 | 0 | 0.38 | 0.38 | 0.34 | 0.37 | 0.37 | 0.38 | 0.39 |
| | 1 | 0.39 | 0.39 | 0.38 | 0.37 | 0.35 | 0.37 | 0.35 |
| | 100 | 0.34 | 0.39 | 0.39 | 0.38 | 0.35 | 0.37 | 0.35 |
| | 300 | 0.34 | 0.36 | 0.36 | 0.39 | 0.51 | 0.35 | 0.38 |
| | 500 | 0.37 | 0.40 | 0.39 | 0.36 | 0.34 | 0.47 | 0.39 |
| Comparative Example 3 | 0 | 0.25 | 0.27 | 0.26 | 0.28 | 0.29 | 0.29 | 0.26 |
| | 1 | 0.24 | 0.86 | 0.58 | 0.79 | 0.65 | NG | NG |
| | 100 | NG | NG | 1.40 | NG | NG | NG | NG |
| | 300 | NG | NG | NG | NG | NG | NG | NG |
| | 500 | NG | NG | NG | NG | NG | NG | NG |

Note 1) NG shows an incapable measurement due to over limiting value

EXAMPLE 4

A metal sheet 11 having a dense structure, in which a number of through holes 6 each having a hexagonal shape are arranged so as to provide a honeycomb structure, was manufactured by performing an etching treatment on a metal sheet formed of nickel having a height of 50 $\mu$m. In this thus manufactured metal sheet 11, a line width was 60 $\mu$m, a space width was 100 um, a hole area was 8660 $\mu m^2$ and an opening was 39.1%.

Gold plating was effected over an entire surface of the thus manufactured metal sheet 11 so as to provide a plated thickness of 0.5 $\mu$m, and thereafter, a contact structure was prepared with the same conditions as those in the Example 1 and a conduction test was then performed with the same conditions as those of Example 1. Test results are shown in Table 4.

COMPARATIVE EXAMPLE 4

A contact structure was manufactured with the same conditions as those in Example 4 except that no through holes were formed in the metal sheet. Test results are shown in Table 4.

TABLE 4

(Unit: V)

| Classification | The Number of Times The Switch was pressed | The Number of Arranged Insulating Foreign Materials 1 | 5 | 10 | 15 | 20 | 40 | 60 |
|---|---|---|---|---|---|---|---|---|
| Example 4 | 0 | 0.18 | 0.16 | 0.18 | 0.16 | 0.16 | 0.18 | 0.19 |
| | 1 | 0.19 | 0.18 | 0.18 | 0.19 | 0.17 | 0.17 | 0.18 |
| | 100 | 0.18 | 0.18 | 0.19 | 0.18 | 0.18 | 0.18 | 0.21 |
| | 300 | 0.19 | 0.19 | 0.22 | 0.18 | 0.18 | 0.18 | 0.19 |
| | 500 | 0.19 | 0.19 | 0.21 | 0.21 | 0.19 | 0.19 | 0.19 |
| Comparative Example 4 | 0 | 0.15 | 0.16 | 0.15 | 0.15 | 0.15 | 0.15 | 0.15 |
| | 1 | 0.16 | 0.15 | 0.16 | 0.16 | 0.16 | 0.19 | 0.19 |
| | 100 | 0.19 | 0.19 | 0.23 | 0.17 | 0.23 | 0.23 | 0.28 |
| | 300 | 0.23 | 0.21 | 0.23 | 0.23 | 0.25 | 0.21 | 0.28 |
| | 500 | 0.16 | 0.16 | 0.16 | 0.28 | 0.25 | 0.26 | 0.19 |

EXAMPLE 5 AND COMPARATIVE EXAMPLE 5

The same conduction tests were performed, by using the same contact structures as those of Example 4 and Comparative Example 4, except that insulating foreign materials 5, each being substantially spherical and having a particle diameter of 100 $\mu$m, were utilized. Test results are shown in Table 5.

TABLE 5

(Unit: V)

| Classification | The Number of Times The Switch was pressed | The Number of Arranged Insulating Foreign Materials 1 | 5 | 10 | 15 | 20 | 40 | 60 |
|---|---|---|---|---|---|---|---|---|
| Example 5 | 0 | 0.19 | 0.18 | 0.18 | 0.18 | 0.18 | 0.18 | 0.18 |
| | 1 | 0.19 | 0.18 | 0.18 | 0.18 | 0.18 | 0.19 | 0.19 |
| | 100 | 0.18 | 0.19 | 0.18 | 0.19 | 0.19 | 0.16 | 0.18 |
| | 300 | 0.19 | 0.19 | 0.17 | 0.16 | 0.19 | 0.25 | 0.25 |
| | 500 | 0.18 | 0.18 | 0.19 | 0.18 | 0.23 | 0.25 | 0.28 |
| Comparative Example 5 | 0 | 0.15 | 0.15 | 0.15 | 0.15 | 0.15 | 0.15 | 0.15 |
| | 1 | 0.16 | 0.16 | 0.90 | 1.3 | 1.4 | NG | NG |
| | 100 | 0.18 | 0.15 | 0.50 | 0.38 | 1.01 | NG | NG |
| | 300 | 0.16 | 0.16 | 0.85 | NG | 1.20 | NG | NG |
| | 500 | 0.17 | 0.17 | 0.17 | 0.98 | NG | NG | NG |

Note 1) NG shows an incapable measurement due to over limiting value

As can be seen from Tables 1 to 5, in Comparative Examples 1 to 5 in which a metal sheet provided with no through holes were utilized, large voltage drops were indicated in cases where the insulating foreign materials 5 becomes larger, an amount of existing insulating foreign materials 5 is increased, and an amount of times the switch was pressed increased.

On the other hand, in Examples 1 to 5 in which contact structure 1 provided with through holes 6 was utilized, voltage drop values did not show large change and were stable.

Furthermore, in comparison with Examples 1 to 3 in which the metal member 7 of the contact structure 1 was formed of stainless steel, in Examples 4 and 5 in which the metal member 7 was formed of nickel, a small voltage drop was observed and, hence, a push-button switch member having better conductivity was produced.

Further, in view of the test results of Examples 1 to 5 and Comparative Examples 1 to 5, it was confirmed that, in a case of using insulating foreign materials, having substantially spherical shape, mainly including ones each having a particle diameter of 50 to 100 $\mu$m, which are liable to adhere during use of a push-button switch of a portable phone, use of a metal member having a space width of 100 to 400 $\mu$m and an opening of 30 to 90% was preferably desirable.

EXAMPLE 6

There were manufactured contact structures 1, each formed of SUS304 material, having a line width of 20 $\mu$m, a space width of 185 $\mu$m and a hole area of 29640 $\mu m^2$, and using a dense honeycomb structure and a mesh structure (line diameter of 20 $\mu$m) by the same method as in Example 1.

Push-button switch members were prepared by using such contact structures 1, and an outer appearance and resistance thereof, after pressing them with a load of 200 g and with no current load, were compared. Evaluation of the outer appearance was performed by visually observing a contacting surface, and one having an injury or defect was considered to be bad (X). Evaluation of resistance was performed observing sparks which were generated at a time of lowering of an insulating resistance between two patterns on stationary substrates 3, and when a spark was observed it was considered to be bad or defective (X). Results are shown in Table 6.

EXAMPLE 7

There was manufactured a contact structure 1 with substantially the same conditions as those in Example 6 except for a line width of 30 $\mu$m, a space width of 175 $\mu$m and a hole area of 26522 $\mu m^2$, and comparison was made between the honeycomb shape dense structure and the mesh structure (wire diameter of 30 $\mu$m). Results are shown in Table 6.

TABLE 6

(Unit: V)

| | The Number of Times the Switch was pressed | Mesh Structure Outer Appearance | Mesh Structure Resistance | Honeycomb Densed Structure Outer Appearance | Honeycomb Densed Structure Resistance |
|---|---|---|---|---|---|
| Example 6 | 5 | x | ○ | ○ | ○ |
| | 10 | x | x | ○ | ○ |
| | 50 | x | x | ○ | ○ |
| | $10^6$ | x | x | x | x |
| Example 7 | 5 | x | ○ | ○ | ○ |
| | 10 | x | ○ | ○ | ○ |
| | 50 | x | x | ○ | ○ |
| | $10^6$ | x | x | ○ | ○ |

As can be seen from Table 6, the contact structure utilizing the honeycomb shape dense structure provided excellent durability as compared with the contact structure utilizing the mesh structure.

Since the contact structure of the mesh structure has, on its contact surface, a number of recessed portions penetrating in the height direction, an advantageous effect with regard to foreign materials could be expected as well as the contact structure of the honeycomb shaped structure. However, since vertical and horizontal wires of the mesh structure are inferior in terms of durability, this is not available for use requiring durability, though being applicable to a push-button switch which does not require much durability.

In addition, from Table 6, it is confirmed that the contact structure in the case of the honeycomb shape dense structure could provide usable durability so long as it has a line width of 20 $\mu$m. However, it is difficult to manufacture a structure having a line width of less than 20 $\mu$m, so that it is desired that the structure has a line width of not less than 20 $\mu$m.

INDUSTRIAL APPLICABILITY

According to the present invention, it is possible to provide a push-button switch member that hardly causes a conductive fault even in presence of fine insulating foreign material. This push-button switch member could therefore be preferably utilized as a push-button switch member for a power window, door mirror or the like, having a contact to which high electric current passes, or one having a normally closed type contact for which it is required to prevent a sticking phenomenon.

What is claimed is:

1. A member for a push-button switch, comprising:

a metal member having holes extending therethrough, with each of said holes being defined by a corresponding metal wall of said metal member, and with each said corresponding metal wall having a flat surface at one end of said metal member such that said one end defines a contact surface that is to be contacted with an opposing electrode; and a flexible resin in said each of said holes, said flexible resin reinforcing said each said corresponding metal wall.

2. The member according to claim 1, wherein said each of said holes is completely filled by said flexible resin.

3. The member according to claim 2, wherein said metal member having said holes defines a dense honeycomb-like structure, with said each of said holes having an identical cross-sectional shape.

4. The member according to claim 1, wherein said metal member having said holes defines a dense honeycomb-like structure, with said each of said holes having an identical cross-sectional shape.

5. The member according to claim 4, wherein said cross-sectional shape is triangular.

6. The member according to claim 4, wherein said cross-sectional shape is pentagonal.

7. The member according to claim 4, wherein said cross-sectional shape is octagonal.

8. The member according to claim 4, wherein said cross-sectional shape is circular.

9. The member according to claim 4, wherein a ratio of a cross-sectional area of all of said holes to a cross-sectional area of all of said corresponding metal walls is within a range of from about 39% to about 81%.

10. The member according to claim 1, wherein said flexible resin is exposed at a lower end portion of said each of said holes.

11. The member according to claim 10, wherein said each of said holes is completely filled by said flexible resin.

12. The member according to claim 10, wherein a ratio of a cross-sectional area of all of said holes to a cross-sectional area of all of said corresponding metal walls is within a range of from about 39% to about 81%.

13. The member according to claim 1, wherein said each said corresponding metal wall is locally deformable in accordance with a shape of a foreign material upon the foreign material being clamped between said each said corresponding metal wall and the opposing electrode.

14. The member according to claim 13, wherein said each of said holes is completely filled by said flexible resin.

15. The member according to claim 13, wherein a ratio of a cross-sectional area of all of said holes to a cross-sectional area of all of said corresponding metal walls is within a range of from about 39% to about 81%.

16. A method of manufacturing a member for a push-button switch, comprising:

providing a metal member having holes extending therethrough, with each of said holes being surrounded by a corresponding metal wall of said metal member, and with each said corresponding metal wall having a flat surface at one end of said metal member such that said one end defines a contact surface that is to be contacted with an opposing electrode; and filling a flexible resin into said each of said holes such that said flexible resin reinforces said each said corresponding metal wall.

17. The method according to claim 16, wherein filling a flexible resin into said each of said holes comprises arranging a flexible resin sheet at one end of said metal member and then applying a pressure to said flexible resin sheet so as to force material of said flexible resin sheet into said each of said holes.

18. The method according to claim 17, further comprising:

punching from said metal member having said each of said holes filled with said flexible resin, a contact structure of a predetermined shape that includes a group of said each of said holes filled with said flexible resin.

19. The method according to claim 18, further comprising:

joining said contact structure to a keypad.

20. The method according to claim 19, wherein providing a metal member having holes extending therethrough comprises providing a dense honeycomb-like structure, with said holes each having an identical cross-sectional shape, such that said contact structure is a dense honeycomb-like structure having holes of the identical shape.

21. The method according to claim 16, wherein providing a metal member having holes extending therethrough comprises providing a dense honeycomb-like structure, with said holes each said holes each having an identical cross-sectional shape.

* * * * *